US005292374A

United States Patent [19]

Maresch et al.

[11] Patent Number: 5,292,374

[45] Date of Patent: Mar. 8, 1994

[54] PROCESS AND PLANT FOR PICKLING STAINLESS STEEL STRIP

[75] Inventors: Gerald Maresch, Mödling; Wilhelm Hofkirchner, Gablitz; Erich Mahr, Purkersdorf, all of Austria

[73] Assignee: Maschinenfabrik Andritz Actiengesellschft, Graz-Andritz, Austria

[21] Appl. No.: 839,896

[22] Filed: Feb. 25, 1992

Related U.S. Application Data

[63] Continuation of Ser. No. 436,635, Nov. 15, 1989.

[30] Foreign Application Priority Data

Nov. 15, 1988 [AT] Austria ..... A2799/88

[51] Int. Cl.[5] ..... C23G 1/02

[52] U.S. Cl. ..... 134/3; 134/15; 134/26; 134/28; 134/41

[58] Field of Search ..... 134/3, 6 R, 15, 28, 134/39, 122 R, 199

[56] References Cited

U.S. PATENT DOCUMENTS 3,429,792 2/1969 Fukui et al. ..... 134/26
3,536,601 10/1970 Hill et al. ..... 134/1
4,255,239 3/1981 Soepenberg ..... 204/34
4,857,225 8/1989 Terada et al. ..... 134/3
4,872,245 10/1989 Kawasaki ..... 29/81.03
4,901,744 2/1990 Hansen ..... 134/108
4,904,352 2/1990 Witte ..... 205/177
4,924,891 5/1990 Soubrier et al. ..... 134/64 R

OTHER PUBLICATIONS

BSC Stainless Sheffield Works, Steel Times, Jul. 1978, pp. 538–566.

*Primary Examiner*—Anthony McFarlane
*Attorney, Agent, or Firm*—Keck, Mahin & Cate

[57] ABSTRACT

In a process and plant for pickling steel strip, a highly refined steel strip is delivered in the form of a coil, uncoiled by an uncoiling hasp 1 and advanced through at least one predescaling plant 3, pickling sections and a rinsing plant 7 to a recoiling hasp 9 or a transverse cutting plant. The strip is clamped to the recoiling hasp 9 ,--,--; recoiled and drawn solely thereby or in conjunction with other driven treatment rolls through the treatment plant or is cut into sheets by the transverse cutting plant. The plant comprises at least one elongated, preferably shallow pickling vat having a supporting structure of steel, glass fibre reinforced synthetic resin or polypropylene and a lining of acid and abrasion resistant material including PVC, carbon bricks, graphite filled and/or aluminium oxide filled polyester resin.

15 Claims, 3 Drawing Sheets

PROCESS AND PLANT FOR PICKLING STAINLESS STEEL STRIP

This application is a continuation of application Ser. No. 07/436,635, filed Nov. 15, 1989.

BACKGROUND OF THE INVENTION

The invention relates to a process and to a plant for pickling steel strips.

According to conventional processes, hot and cold strips of steel are treated in continuous annealing and pickling lines. In this procedure the belt in coiled form ,--,--; is unwound off an uncoiling hasp and connected to the end of a preceding coil in a welding machine. In order to avoid stoppages in the plant and resultant over-pickling of the preceding belt ,--,--; the strip is withdrawn during the stationary period of the belt in the uncoiling section from a strip store means. The incoming strip is first annealed in an annealing oven ,--,--; cooled with air and water, whereafter the scale is removed in a pickling plant. A large variety of methods for pickling a hot or cold strip has found acceptance in the industry, the best known method being pickling with neutral electrolyte followed by mixed acid post-treatment. In this context ,--,--; mixed acid denotes a mixture of nitric and hydrofluoric acid. After rinsing ,--,--; the strip is dried and recoiled. The resulting welding seams are cut out in this process, resulting once again in a coil of approximately the same length as when entering the plant. This process suffers from drawbacks amongst which primarily a high plant investment and labor input as well as large space requirements are to be mentioned.

As compared with the use of other pickling processes, particularly in,,relation to the passage of the strip through the plant ,--,--; a general technical misconception existed that the conventional material might cause damage to the strip. In particular ,--,--; it was feared that the brick linings of pickling vessels might result in scratching or similar impairment of the strip, this in particular when pickling stainless steel strip.

On the other hand ,--,--; materials are needed for lining the pickling plant which are capable of withstanding the chemical attack by the treatment chemicals as well as the mechanical wear and tear. Mechanical linings of brick and ceramics, although resistant to chemical attacks, frequently result in damage to the surface of the pickled product or are themselves not capable of readily withstanding mechanical wear and tear.

OBJECTS OF THE INVENTION

Accordingly, it is one object of the present invention to provide a process avoiding the aforesaid drawbacks.

It is a further object of the invention to provide an apparatus for carrying out the process wherein the risk of damage to the pickled products is reduced to a minimum. Further objects, advantages and features will become apparent from what follows.

GENERAL DESCRIPTION OF THE INVENTION

According to one aspect thereof ,--,--; the invention provides a process as set out in the opening paragraph, wherein a highly refined steel strip is delivered to the pickling plant in the form of a coil, and is uncoiled by an uncoilinq hasp and advanced at least through one preliminary descaling plant, pickling sections and a rinsing plant until it reaches at the end of the treatment line ,--,--; rewinding hasp or a transverse parting plant, whereafter the strip is either clamped to the recoiling hasp and recoiled and is drawn solely by the latter or by coaction of other driven treatment rolls through the treatment plant or is cut into sheets by the transverse parting plant.

Preferably ,--,--; the belt passes through a plurality of pickling sections comprising different pickling media. In the course thereof, ,--,--; the strip may be treated in at least one section with sulphuric acid and in a subsequent section with a mixture of nitric and hydrofluoric acid.

The concentration of the sulphuric acid amounts to 250–600 g/l, preferably 300–450 g/l. The temperature of this pickling acid may be 60–95, preferably 70°–90° C.

In the case of the mixed acid, the concentration of the nitric acid may be 100–250 g/l, preferably 100–200 g/l and of the hydrofluoric acid 10–100, preferably 20–80 g/l, calculated as total available hydrofluoric acid. In this context, ,--,--; the temperature of the mixed acid may be 40–70, preferably 40°–65° C.

For carrying out the process according to the invention, a plant is proposed using at least one uncoiling hasp, one belt guide means, at least one pickling section, one rinsing plant and one rewinding hasp and respectively or a transverse parting plant, the pickling vessel according to the invention comprising a support structure of steel, glass fibre reinforced synthetic resin or polypropylene and a lining of acid- and abrasion-resistant material comprising PVC, carbon bricks, graphite filled and/or aluminium oxide filled polyester resin.

According to a further feature of the invention, at least two pickling vats, each comprising at least one pickling section, ,--,--; are provided, a wash brushing machine being provided between the pickling vats.

BRIEF DESCRIPTION OF THE DRAWINGS

Further details of the invention will be further explained with reference to the drawing in which a working example of the relevant plant is illustrated. There is shown in diagrammatic manner in FIG 1, a perspective view of the plant including the most important facilities, FIG. 2, a longitudinal section of the plant in the region between the end of a pickling section and the beginning of the next following pickling section, FIG. 3, a longitudinal section through the ends of two pickling vats including the wash brushing machine therebetween, FIG. 4, a longitudinal section through the countercurrent rinsing plant and FIG. 5, a longitudinal section through the bottom of the pickling vessel.

DESCRIPTION OF SPECIFIC EMBODIMENTS OF THE INVENTION

Figure 1:
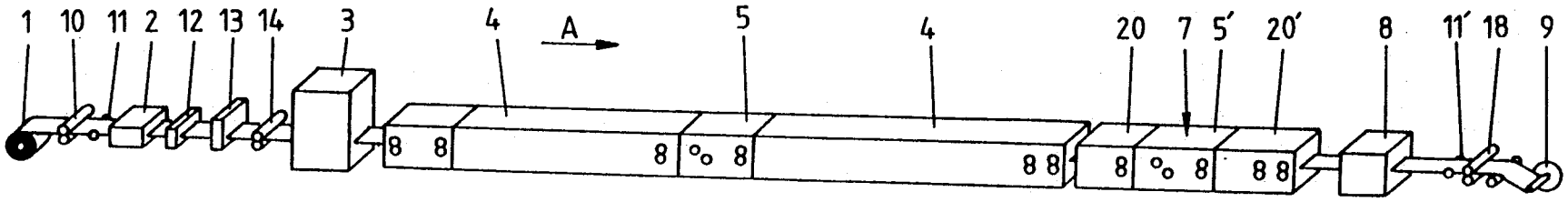

The plant illustrated in FIG. 1 comprises essentially an uncoiling hasp 1, a straightening machine 2, a mechanical predescaling plant, e.g., --,---; an abrasive blaster 3, two elongate flat pickling vats 4 with a wash brushing machine 5 therebetween, a countercurrent rinsing plant 7, a drier 8 and a recoiling hasp 9. Between the uncoiling hasp 1 and the straightening machine 2, a pusher 10 composed of two superimposed rolls as well as two mutually opposing guide rolls 11 are provided.

Between the straightening machine 2 and the abrasive blaster 3, two guillotines 12, 13 as well as a pusher 14 are provided, the latter in turn comprising two superimposed rolls.

Between the drier 8 and the recoiler hasp 9, --,---; a strip guide means 11' composed of two mutually opposing guide rolls, one on each side of the strip 14 to be pickled, is provided, followed by a reverse traction assembly 18 formed by two superimposed rolls.

Figure 2:
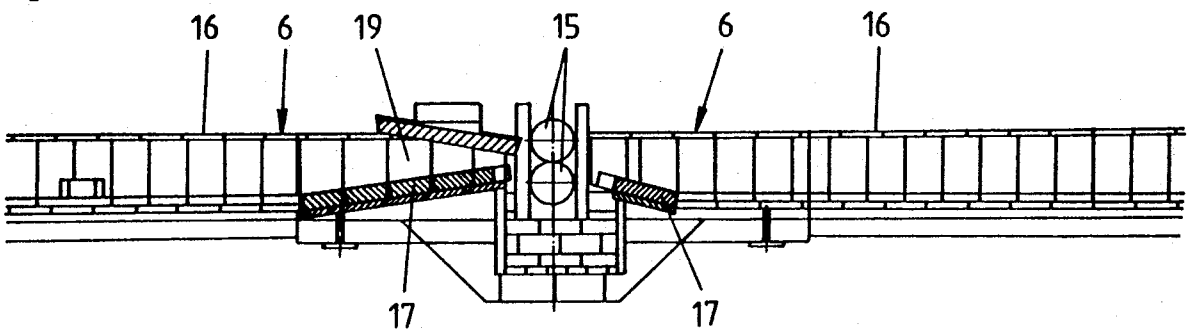

At least one of the pickling vats 4 comprises at least two successive pickling sections 6, between which the strip passes between two squeegee rolls 15 (FIG. 2) of which the uppermost is driven and contributes to the advance of the strip. The pickling vat 4, respectively in each of the pickling sections 6 is provided with a sectionally liftable lid 16 on the inlet as well as the outlet side with a sloping bottom region 17 forming a weir for the pickling acid contained in the vat 4, respectively in the pickling section 6. The geometry of these bottom regions 17 is such that the region on the inlet side slopes downwardly in the direction of travel of the strip, whilst the region on the outlet side slopes upwardly. Thus, the region on the outlet sides with a corresponding region of the lid 16 forms a funnel 19 for guiding between the squeegee rolls 15 the beginning of the strip which is inclined to rise upright.

The pickling vat, respectively the pickling section 6 itself is constructed of a carrying structure and a lining of acid and abrasion resisting material. The carrying structure is composed of steel with a lining of chlorinated PVC, respectively of glass fibre reinforced plastics or pure plastics such as e.g. polypropylene. This is followed by a layer of carbon bricks and for the uppermost layer polyester resin filled with aluminium oxide, respectively graphite, is used.

The amount of filler may be between 10 and 100% by mass in the case of aluminium oxide, preferably between 20 and 50% by mass. If graphite is used as the filler, the values are between 50 to 400, preferably between 80 to 200% by mass.

This combination of polyester resin matrix and filler results in a material which on the one hand is adequately resistant to the chemical and mechanical wear and tear of the pickling operation but which cannot damage the high quality steel strip.

Figure 4:
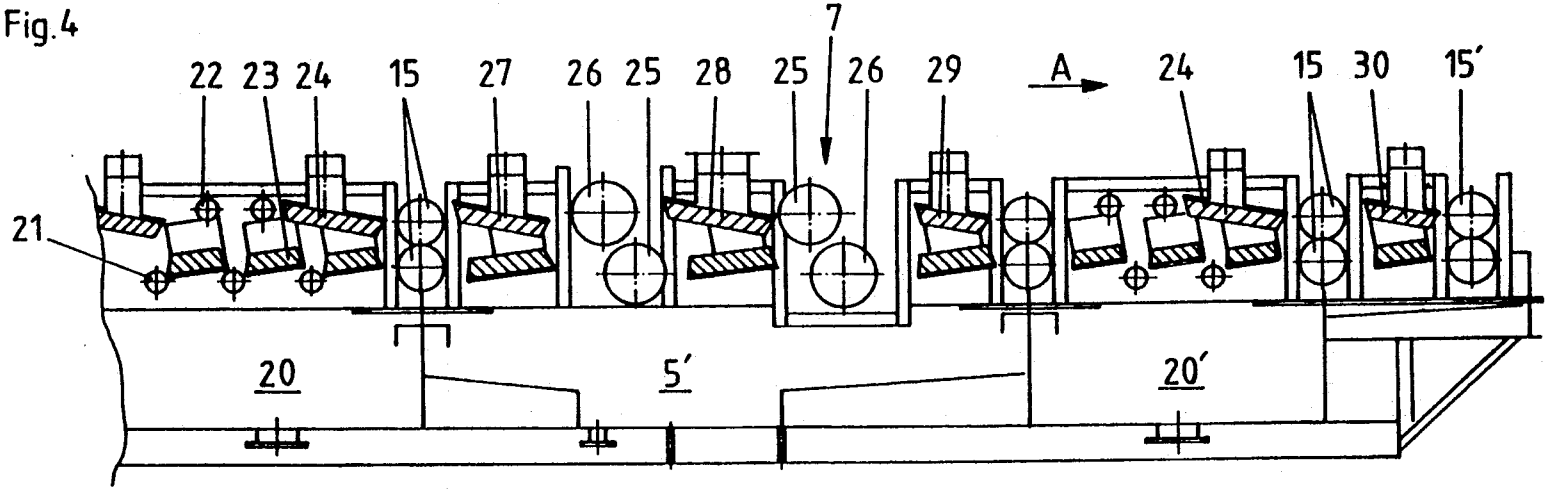

The countercurrent rinsing plant 7, as shown in FIG. 4, comprises a wash brushing machine 5' and both upstream and downstream each a rinsing plant 20, respectively 20'. On the feed as well as the discharge side, ,--,--; each rinsing plant, respectively between rinsing plants 20, respectively 20' and the wash brushing machine 5', superimposed squeegee rolls 15, similar to those between the pickling sections 6, are provided, of which at least the upper one is driven. In the rinsing plants 20, 20', ,--,--; lower and upper spray pipes 21, respectively 22 are provided between which the strip to be treated passes in the direction of the arrow A. The bottom of the rinsing plant 20, 20' is formed by panels 23 similar to or equal to the lining of the pickling vats 4 and each sloping upwards in the direction of movement A of the strip. The lower spray pipes 21 are accommodated between the panels 23 and below their upper surface in order to be protected against damage from the strip particularly when the strip end is introduced.

In addition, ,--,--; the lower spray pipes 21 also take care of the formation of a water film between the underside of the belt and the lining material, so that the strip slides on this water film and has no or only light contact with the bottom of the vat. This similarly contributes to the avoidance of mechanical damage both to the pickled product as well as to the plant itself.

For guiding the strip to the squeegee rolls 15, a funnel 24 formed in the present case by a bottom and a lid panel is provided similar to that associated with the pickling sections 6.

The wash brushing machine 5' provided between the rinsing plants 20, 20' successively comprises two pairs of superimposed rolls, namely a support roll 25 and a brush roll 26, viewed in the direction of travel of the strip the support roll 25 in the case of the first pair of rolls being lowermost and in the second pair uppermost, and the lower roll in relation to the upper one being staggered in the direction of travel of the strip 14. In order to avoid damage to the brush rolls 26 when inserting the start of the strip, the first brush roll is raisable and the second one is lowerable. Also, ,--,--; for the same purpose, ,--,--; each of the upper ones of the two squeegee rolls can be raised. Between the two rolls 25, 26 as well as between the first pair of rolls and the preceding squeegee roll pair 15 and the second roll pair and the subsequent squeegee roll pair 15 and the second roll pair and the subsequent squeegee roll pair 15 a funnel 27, respectively 28, respectively 29 is provided in each case, corresponding to the funnel 24.

In the present working example, ,--,--; a second squeegee roll pair 15' is provided on the exit side of the second rinsing plant 20', downstream of the squeegee roll pair 15, a funnel 30 being positioned between the two squeegee roll pairs 15, 15', corresponding to the funnel 24.

The rinsing proceeds as a countercurrent cascade rinsing procedure in which the rinsing medium from the third cascade passes into the second cascade from where it passes into the first cascade, i.e. into the wash brushing machine 5'. From the latter, ,--,--; the rinsing medium passes to the preceding cascade of the rinsing plant 20 and from there to the wash brushing machine 5 located between the two pickling vats 4. The spent rinsing, respectively washing medium drains into a collecting vessel which is not illustrated, from where it is optionally recycled to the rinsing and washing process by way of a treatment plant.

Figure 3:
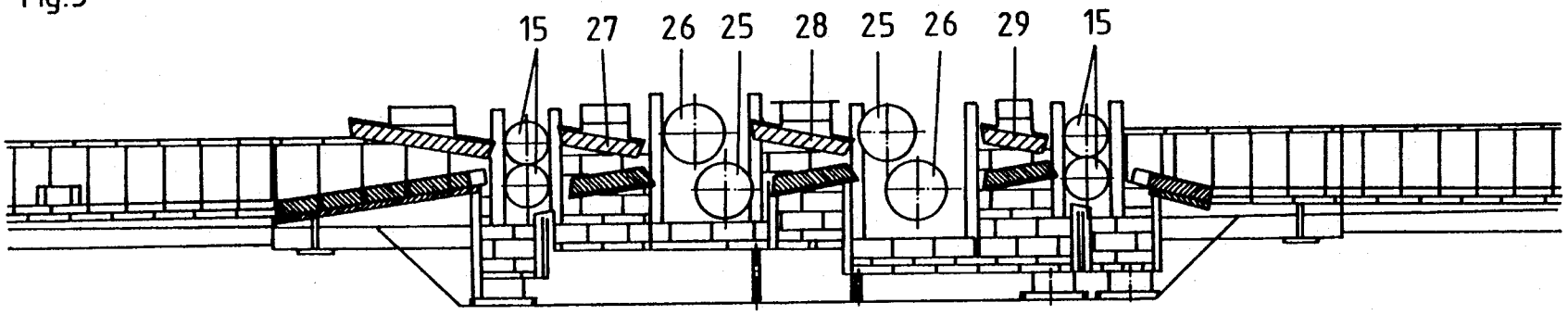

The wash brushing machine 5 located between the pickling vats 4 correspond to the above described wash brushing machine 5', equal components being denoted in FIG. 3 with the same reference symbols.

The process according to the invention proceeds, to the extent not yet described above, in such a manner that at the start of the treatment of a coil held on the uncoiling hasp 1, the latter is driven at least until the start of the strip has reached the pusher means 10 and has been gripped thereby. For centering the strip, ,--,--; the uncoiled hasp 1 may be adjustable transversely to the travelling path of the strip. The pusher means 10 then pushes the strip forward in the direction of the arrow A. The strip guide means 11 prevent lateral malalignment of the strip. The guillotine 12 servers the front end of the strip which, if the strip is received from the rolling mill, is tongue-shaped. The guillotine 13 then trims the edges of the strip front end obliquely so that the strip front end is given a conical taper to promote the guidance of the strip. The strip front end thus receives a trapezium configuration, it being advantageous if the upper side of the trapezium, respectively the end of the strip has a width at least half that of the strip and the angle between the direction of travel and the trapezium sides amounts to between 10 and 80, preferably 30° and 60° C.

In the pickling vats 4, respectively the pickling sections 6, the same pickling medium or different media may be used. In this context the pickling medium is introduced into the pickling vat 4, respectively the pickling section 6 on that side where the strip exits and is discharged at the strip entry side, thereby flowing counter to the movement of the strip. The circulation of the pickling medium in the pickling vat, respectively in the pickling section proceeds at least once and at the most 20 times, preferably 5 to 10 times per hour.

After leaving the countercurrent rinsing plant 7 and the drier 8, the strip is guided by the lateral pulleys or rolls of a strip guide means 11' to the recoil hasp 9, whilst the strip is braked by two superposed rolls of a reverse traction aggregate 18 in order for the windings of the recoiling hasp 9 being tightly wound.

It stands to reason that further treatment steps such as e.g., ,--,--; cold rolling, longitudinal or transverse parting, respectively grinding of the strip in the same plant are feasible and can be installed. An optional cross cutting plant which cuts the pickled finished product into sheets, can take the place of the recoiling hasp 9. A longitudinal parting plant which divides the strip into narrower strips as well as a grinding plant is to be provided upstream of the recoiling hasp 9. In order to avoid over pickling of that part of the strip which is inside the pickling vat, a means is provided by which in the event of the strip being stationary, the pickling vat is drained rapidly and flooded with water. More particular, ,--,--; for the pickling of high quality ferritive steel strip with mixed acid, the latter may be cooled by means of externally fitted heat exchangers. Finally the recoil hasp may be preceded by a rolling mill for reducing the strip thickness.

In order to avoid the escape of vapors or dust from the individual treatment plants, air or vapor may be sucked off from there by ventilation means.

Figure 5:
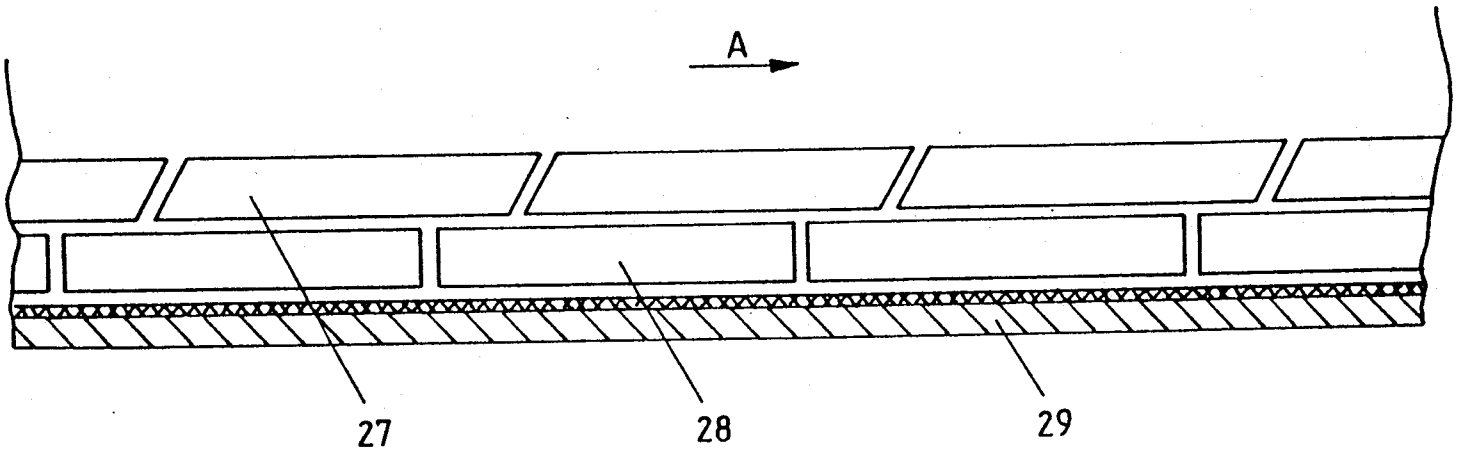

As shown in FIG. 5, the lining material may be composed of sheets having a sawtooth configuration in the direction of travel of the strip and which are laid by means of an acid-resistant cement. In that figure, 27 denotes the synthetic resin blocks which are of sawtooth-like configuration in the direction of strip travel, 28 denoting the carbon bricks there below and 29 the support structure.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A process for pickling a steel strip, in a form of a coil, in a treatment line comprising the steps of:

a) uncoiling the strip by an uncoiling hasp;

b) mechanically descaling the uncoiled strip of step a) by passing the strip through an abrasive blaster;

c) pickling the descaled strip of step b) with a plurality of pickling acids after mechanically descaling the strip;

d) rinsing the pickled strip of step c);

e) clamping the rinsed strip of step d) to a recoiling hasp; and f) recoiling the clamped strip of step e);

wherein the strip is pushed through the treatment line at least until a front end of the strip reaches the recoiling hasp and wherein further the strip is drawn through the treatment line by at least the recoiling hasp.

2. The process of claim 1, wherein the plurality of pickling acids includes at least a mixture of nitric and hydrofluoric acids.

3. The process of claim 1, wherein the plurality of pickling acids includes at least sulfuric acid which is present in a concentration ranging from 250 to 600 g/l.

4. The process of claim 1, wherein the plurality of pickling acids includes at least sulfuric acid which is present in a concentration ranging from 300 to 450 g/l.

5. The process of claim 1, wherein the strip is first treated with sulfuric acid and then treated with a mixture of nitric and hydrofluoric acids during pickling.

6. The process of claim 1, wherein the temperature of the plurality of pickling acids is in the range 60° to 95° C.

7. The process of claim 1, wherein the temperature of the plurality of pickling acids is in the range 70° to 90° C.

8. The process of claim 2, wherein the temperature of the acid mixture is in the range 30° to 70° C., the concentration of the nitric acid is in the range 100 to 250 g/l, and that of the hydrofluoric acid 10 and 100 g/l.

9. The process of claim 2, wherein the temperature of the acid mixture is in the range 40° to 65° C., the concentration of the nitric acid is in the range 100 to 200 g/l and that of the hydrofluoric acid is in the range 20 to 80 g/l.

10. The process of claim 1, wherein the front end of the strip --,---; prior to being inserted into the treatment line --,---; is trimmed to a trapezium configuration, the two corners of a front edge of the strip being trimmed at an angle in the range 30° to 45° measured from the side edges of --,---; strip, and the length of the front edge after trimming of the corners ,--,--; amounting to at least half of the strip width.

11. The process of claim 5, wherein the strip after treatment with sulfuric acid and prior to treatment with the acid mixture is washed and brushed.

12. The process of claim 1, wherein the plurality of pickling acids are cooled by externally fitted heat exchanger means.

13. The process of claim 1, wherein the pickling acids are rapidly drained and the pickling acids are replaced with water during rinsing.

14. The process of claim 1, wherein the strip is additionally drawn through the treatment line by driven treatment rolls.

15. A process for pickling a steel strip, in a form of a coil, in a treatment line, comprising the steps of:

a) uncoiling the strip by an uncoiling hasp;

b) mechanically descaling the uncoiled strip of step a) by passing the strip through an abrasive blaster;

c) pickling the descaled strip of step b) with a plurality of pickling acids after mechanically descaling the strip;

d) rinsing the pickled strip of step c);

e) clamping the rinsed strip of step d) so that the strip may be cut into sheets of shorter lengths; and f) recoiling the clamped strip of step e) into sheets;

wherein the strip is pushed through the treatment line at least until a front end of the strip is clamped.

* * * * *